US007556328B2

(12) United States Patent
Sekiguchi

(10) Patent No.: US 7,556,328 B2
(45) Date of Patent: Jul. 7, 2009

(54) LIQUID-DROPLET JETTING APPARATUS

(75) Inventor: Yasuhiro Sekiguchi, Nagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 409 days.

(21) Appl. No.: 11/639,577

(22) Filed: Dec. 15, 2006

(65) Prior Publication Data

US 2007/0139487 A1 Jun. 21, 2007

(30) Foreign Application Priority Data

Dec. 16, 2005 (JP) ..... 2005-362823

(51) Int. Cl.
*B41J 29/38* (2006.01)
*B41J 2/045* (2006.01)

(52) U.S. Cl. ..... 347/11; 347/70

(58) Field of Classification Search ..... 347/9–11, 347/68, 70–72

See application file for complete search history.

(56) References Cited

U.S. PATENT DOCUMENTS 6,257,685 B1 * 7/2001 Ishikawa ..... 347/10
6,412,896 B2 * 7/2002 Takahashi et al. ..... 347/11
6,431,674 B2 8/2002 Suzuki et al.
6,955,418 B2 10/2005 Ito

FOREIGN PATENT DOCUMENTS

| | | |
|---|---|---|
| JP | 3190747 | 8/1991 |
| JP | 2000177126 | 6/2000 |
| JP | 2004-25636 | 1/2004 |
| JP | 3613297 | 11/2004 |

* cited by examiner

*Primary Examiner*—An H Do
(74) *Attorney, Agent, or Firm*—Reed Smith LLP

(57) ABSTRACT

A liquid-droplet jetting apparatus such as an ink-jet printer makes a meniscus of an ink in a nozzle vibrate by applying a no-jetting drive pulse which does not jet the ink. An operation of outputting two no-jetting drive pulses in one cycle is repeated for 100 to 150, and then stopped for 100 to 150 cycles. A pulse width Tp of the no-jetting drive pulses, an interval Tw between two no-jetting drive pulses, and a time AL in which a pressure wave in an ink channel is propagated one way are set to be in a range 0.1 AL≦Tp≦0.2 AL, and 0.2 AL≦Tw≦4.5 AL. Accordingly, it is possible to prevent assuredly, thickening of a liquid such as an ink in the nozzle, and to reduce a generation of a defect in jetting of a liquid droplet.

15 Claims, 9 Drawing Sheets

| | | Tp | | | | |
|---|---|---|---|---|---|---|
| | | 0.13AL | 0.18AL | 0.22AL | 0.27AL | 0.31AL |
| Tw | 0.11AL | A | B | D | D | D |
| | 0.22AL | A | A | C | D | D |
| | 0.33AL | A | A | C | D | D |
| | 0.44AL | A | A | A | A | A |
| | 0.89AL | A | A | A | A | A |
| | 1.33AL | A | A | A | A | B |
| | 1.78AL | A | A | B | C | C |
| | 2.22AL | A | AA | B | C | C |
| | 2.67AL | A | AA | AA | A | B |
| | 3.11AL | A | AA | A | A | B |
| | 3.56AL | A | A | A | B | C |
| | 4.00AL | A | A | A | C | C |
| | 4.44AL | A | A | A | A | C |

AA NO DISCHARGE, NO INK-DRYING
A NO DISCHARGE
B DISCHARGE AT 34 °C AND MORE
C DISCHARGE AT 24 °C AND MORE
D DISCHARGE

Fig. 6

| | | Tp | | | | |
|---|---|---|---|---|---|---|
| | | 0.13AL | 0.18AL | 0.22AL | 0.27AL | 0.31AL |
| Tw | 0.11AL | A | B | D | D | D |
| | 0.22AL | A | A | C | D | D |
| | 0.33AL | A | A | C | D | D |
| | 0.44AL | A | A | A | A | A |
| | 0.89AL | A | A | A | A | A |
| | 1.33AL | A | A | A | A | B |
| | 1.78AL | A | A | B | C | C |
| | 2.22AL | A | AA | B | C | C |
| | 2.67AL | A | AA | AA | A | B |
| | 3.11AL | A | AA | A | A | B |
| | 3.56AL | A | A | A | B | C |
| | 4.00AL | A | A | A | C | C |
| | 4.44AL | A | A | A | A | C |

AA NO DISCHARGE, NO INK-DRYING
A NO DISCHARGE
B DISCHARGE AT 34 °C AND MORE
C DISCHARGE AT 24 °C AND MORE
D DISCHARGE

LIQUID-DROPLET JETTING APPARATUS

CROSS REFERENCE TO RELATED APPLICATION

The present application claims priority from Japanese Patent Application No. 2005-362823, filed on Dec. 16, 2005, the disclosure of which is incorporated herein by reference in its entirely.

BACKGROUND OF THE INVENTION

1. Field of the Invention

The present invention relates to a liquid-droplet jetting apparatus which jets a liquid droplet. For example, the present invention relates to a control for preventing an occurrence of a printing defect which is caused due to drying of a liquid near an opening of a nozzle, in a liquid-droplet jetting apparatus such as an ink-jet printer.

2. Description of the Related Art

A conventional liquid-droplet jetting apparatus such as an ink-jet printer includes a carriage on which a recording head having a plurality of nozzles discharging an ink is mounted. The recording head includes pressure chambers which communicate with the nozzles respectively, and an actuator which applies a pressure to the ink in the pressure chambers. An example of the actuator is a piezo-electric actuator. The ink is filled in the pressure chambers which communicate with these nozzles, and a drive pulse is applied to a piezoelectric actuator. Accordingly, a pressure deformable portion of the actuator is deformed, and a certain pressure chamber of the pressure chambers is expanded or contracted. Due to the expansion or contraction of the certain pressure chamber, a jetting pressure is applied to the ink in the certain pressure chamber. When the jetting pressure is applied to the ink, the ink is jetted on to a recording medium from a nozzle communicating with the certain pressure chamber, while the carriage performs a reciprocal moving.

Incidentally, in a recording head which performs a printing by jetting (discharging) the ink from the nozzles, when the printing is stopped, for a nozzle having a low frequency of jetting, a solvent (water etc.) in the ink is thickened due to gradual drying. Accordingly, a size of an ink droplet is reduced, and a malfunctioning such as the ink is hardly jetted occurs, which causes a decline in a printing performance. In such case, before a start of printing and/or during a printing operation, the carriage is moved periodically or forcibly up to a flushing portion which is a no-printing area, and by applying a drive pulse, a flushing operation (auxiliary jetting) of discharging the ink forcibly from each of the nozzles is performed, or, a so-called maintenance operation such as moving the carriage to a cap portion, and then performing a purge process of removing air bubbles and impurities by a forcible suction by applying a negative pressure to the nozzles, is performed.

However, while the purge process and the flushing process are effective in removing the air bubbles and impurities on one hand, the carriage is to be moved to the no-printing area other than the printing area, on the other hand. Therefore, there are problems such as a decrease in the printing speed, and a wasteful consumption of the ink. In Japanese Patent Application Laid-open No. H3-190747, and Japanese Patents No. 3318568 and 3613297, an arrangement is made such that when the ink is not jetted, apart from a drive pulse which jets the ink on to the recording medium, a no-jetting drive pulse which does not jet the ink is applied to the actuator, and by making a meniscus of the ink near the nozzle opening vibrate minutely, the drying of the ink is prevented to keep a viscosity of the ink low.

In Japanese Patent Application Laid-open No. H3-190747, particularly, an example in which, when the carriage is at the no-printing area, the meniscus is made to vibrate minutely in an effective manner, is described. An area in which the carriage is accelerated and decelerated and the recording head is in a no-printing state (acceleration and deceleration area, no-printing area), is provided on both sides of a recording area in which the printing is performed by causing the carriage mounted on the recording head to perform a reciprocating movement. An arrangement is made such that when the carriage moves from the printing area to this acceleration and deceleration area (no-printing area), minute vibrations are imparted to a meniscus of the ink by applying a voltage to the actuator, to an extent that an ink droplet is not jetted. Accordingly, the ink is supplied to a front end portion of the nozzles, and a uniform wetting is maintained in the front end portion of the nozzles. By making such an arrangement, upon printing of one line, in the no-printing area, minute vibrations are imparted to the front end portion of the nozzles, and the thickening of the ink in the front end portion of the nozzles is prevented.

A no-jetting drive pulse described in Japanese Patent No. 3318568, includes only a signal which is output with a frequency close to a natural frequency (characteristic frequency) of the pressure chamber when no recording is performed, and by applying such no-jetting drive pulse to the actuator, the pressure chamber is let to be in a resonance state. Applying the signal at the frequency close the natural frequency of the pressure chamber, it is possible to let the pressure chamber to be in the resonance state, even when the signal is applied for a short time, and it is possible to detach by vibration the air bubble from a wall surface of the pressure chamber. Therefore, (an operation of) applying this no-jetting drive pulse is effective. A time for which the signal of this frequency is applied may be a time of several cycles, and a several times to several tens of times of this time is let to be a stopping time (pause time), and reverberation of the vibration is converged (accumulated). The air bubbles or the impurities in the ink are removed effectively by repeating such series of no-jetting drives.

Moreover, in an ink-jet recording head described in U.S. Pat. No. 6,431,674 (corresponding to Japanese Patent No. 3613297), a first mode in which, at the time of stop which is the no-printing state, the no-jetting drive pulse (second driving signal) is applied intermittently to the actuator (piezoelectric resonator), is executed, and further, a second mode in which the no-jetting drive pulse is applied to the actuator for a time longer than the time in the first mode, is executed just before the printing. By changing the minute vibrations according to the mode, the thickened ink is stirred while reducing a fatigue of the actuator, and clogging of the nozzle is prevented.

SUMMARY OF THE INVENTION

As it has been described above, by making the meniscus of ink vibrate minutely by applying a no-jetting drive pulse to an actuator, efforts have been made to suppress a decline in a printing performance due to drying of ink. However, with an improvement in speeding up of an ink-jet printer, conditions of use of the ink-jet printer required by a user have been becoming strict. With this, preventing further effectively the decline in the printing performance due to the drying of ink, reducing an amount of wasteful consumption of ink due to a frequent flushing process, and shortening of a printing time is being required by the user.

The present invention is made in view of the abovementioned circumstances, and an object of the present invention is to prevent assuredly the thickening of the ink in the nozzles, and to reduce a defect in jetting of the liquid.

According to a first aspect of the present invention, there is provided a liquid-droplet jetting apparatus which jets a droplet of a liquid onto a medium, including a head which includes a pressure chamber in which the liquid is filled, a nozzle which communicates with the pressure chamber, a channel which is extended from the pressure chamber up to the nozzle, and an actuator which changes a volume of the pressure chamber, and a controller which controls the actuator to impart vibration to a meniscus of the liquid in vicinity of the nozzle by applying no-jetting drive pulses, which causes no jetting of the liquid onto the medium, to the actuator.

When a period of time during which a pressure wave generated due to the vibration is propagated in one way through the channel is AL, a pulse width of the no-jetting drive pulses is Tp, and an interval between each of the no-jetting drive pulses is Tw, a waveform of the no-jetting drive pulses satisfies one of $$0.1AL \leqq Tp \leqq 0.2AL,\ 0.2AL \leqq Tw \leqq 4.5AL;$$

$$0.1AL \leqq Tp \leqq 0.15AL,\ 0.1AL \leqq Tw \leqq 4.5AL;$$

$$0.1AL \leqq Tp \leqq 0.35AL,\ 0.4AL \leqq Tw \leqq 1.0AL;$$

$$0.1AL \leqq Tp \leqq 0.3AL,\ 0.4AL \leqq Tw \leqq 1.5AL;$$

$$0.1AL \leqq Tp \leqq 0.3AL,\ 2.5AL \leqq Tw \leqq 3.5AL;$$

$$0.1AL \leqq Tp \leqq 0.25AL,\ 2.5AL \leqq Tw \leqq 4.5AL;\ \text{and}$$

$$0.1AL \leqq Tp \leqq 0.3AL,\ 4.2AL \leqq Tw \leqq 4.5AL.$$

In this case, it is possible to impart the vibration to the meniscus of the liquid near the nozzle effectively, and reduce a jetting defect by preventing the thickening of liquid.

In the liquid-droplet jetting apparatus of the present invention, the waveform of the no-jetting drive pulses may satisfy $$0.15AL \leqq Tp \leqq 0.2AL,\ 2.0AL \leqq Tw \leqq 3.5AL.$$

Moreover, the waveform of the no-jetting drive pulses may satisfy $$0.15AL \leqq Tp \leqq 0.25AL,\ 2.5AL \leqq Tw \leqq 3.0AL.$$

In these cases, it is possible to have an energy sufficient for stirring (mixing) the thickened liquid and a new liquid by making the meniscus of the liquid at a nozzle opening vibrate to an extent that the liquid is not jetted from the nozzle. Therefore, it is possible to prevent assuredly a jetting defect due to drying of liquid.

In the liquid-droplet jetting apparatus of the present invention, the no-jetting drive pulses may be output repeatedly at a first cycle, and number of the no-jetting drive pulses output in the first cycle may be in a range of one to three. In this case, there is no possibility that the liquid droplet is jetted improperly (mistakenly).

In the liquid-droplet jetting apparatus of the present invention, after the no-jetting drive pulses may be output repeatedly at the first cycle, the no-jetting drive pulses may be stopped during a second cycle which has a length not less than the first cycle. In this case, since the stirring of ink is not repeated monotonously, but with variation, it is possible to stir effectively the liquid thickened due to drying. Moreover, it is possible to achieve a stopping time for suppressing the remained vibration of the meniscus of the liquid which is vibrating, and there is no possibility that the liquid droplet is jetted improperly (mistakenly).

The liquid-droplet jetting apparatus of the present invention, may further include a carriage on which the head is mounted, and which moves reciprocally in a direction of a width of the medium, and the controller may control the carriage to move along the medium, and after an operation of jetting the droplet on to the medium is completed, the controller may impart the vibration to the meniscus of the liquid in the vicinity of the nozzle by supplying the no-jetting drive pulses to the actuator.

In this case, it is possible to impart vibration to the meniscus of the liquid to an extent that the liquid is not jetted from the nozzle, and to suppress the drying of the liquid. Moreover, even for a nozzle having a low frequency (proportion) of jetting the liquid, since the liquid thickened due to drying is stirred with the new liquid, it is possible to prevent the defect in jetting the liquid. Furthermore, since it is not necessary to perform the flushing frequently, a time for returning up to the flushing position is cut short (saved), and it is also possible to reduce the overall printing time.

The liquid-droplet jetting apparatus of the present invention may further include a carriage on which the head is mounted, and which moves reciprocally in a direction of a width of the medium, and the controller may control the carriage to move along the medium, and with a termination of an operation of jetting the droplet on to the medium, the controller may decelerate the carriage, and at the same time, may impart the vibration to the meniscus of the liquid in the vicinity of the nozzle by supplying the no-jetting drive pulses to the actuator.

In this case, it is possible to suppress the drying of the liquid, and to prevent the jetting defect. Moreover, since it is possible to specify the starting of the operation of the no-jetting drive by the acceleration and the deceleration of the carriage, the control becomes easy.

In the liquid-droplet jetting apparatus of the present invention, the controller may continue to impart the vibration to the meniscus of the liquid till just before the carriage arrives at a subsequent jetting area. In this case, since the controller imparts the vibration to the meniscus of the liquid till just before the subsequent jetting area of the carriage, it is possible to stir assuredly the thickened liquid with the new liquid, and to prevent a decline in the printing performance in the subsequent operation.

In the liquid-droplet jetting apparatus of the present invention, the controller may impart the vibration to the meniscus of the liquid for a fixed period of time after starting a supply of the drive pulses to the actuator. In this case, a time for suppressing the remained vibrations of the meniscus on a nozzle opening surface which is vibrating, is made available due to the no-jetting drive, and it is possible to reduce an effect on jetting performance.

The liquid-droplet jetting apparatus of the present invention, may further include a flushing mechanism which performs flushing of the head. In this case, it is possible to eliminate assuredly the thickened liquid from the head.

The liquid-droplet jetting apparatus of the present invention may further include a cartridge which accommodates the liquid, and which is exchangeable. The controller may include a timer which measures a time elapsed after the cartridge has been replaced, and the controller imparts the vibrations to the meniscus of the liquid when the elapsed time exceeds a predetermined time. In this case, even in a case in which the liquid in the cartridge is thickened due to elapsing of a long time, it is possible to stir the liquid effectively.

In the liquid-droplet jetting apparatus of the present invention, the controller may include a thermometer which measures a temperature of the liquid, and may control the flushing mechanism to perform the flushing of the head when the temperature of the liquid is higher than a predetermined temperature. In this case, it is possible to remove (eliminate) assuredly the liquid which is thickened due to a rise in the temperature, from the head.

The liquid-droplet jetting apparatus of the present invention may further include a purge mechanism which performs a purge of the head. The controller may include a timer which measures a time elapsed after the purge of the head has been performed, and when the elapsed time exceeds a predetermined time, the controller may impart the vibration to the meniscus of the liquid by increasing a number of the no-jetting drive pulses. In this case, even in a case in which the liquid in the carriage is thickened due to elapsing of long time, it is possible to stir the liquid effectively.

BRIEF DESCRIPTION OF THE DRAWINGS

FIG. 6 is a diagram showing a result of an experiment when a combination of a pulse width and a pulse interval in the no-jetting waveform which is used in this embodiment, was changed;

DETAILED DESCRIPTION OF THE PREFERRED EMBODIMENTS

An embodiment of the present invention will be described below by referring to the accompanying diagrams. Firstly, an ink-jet printer 1 which is an example of the liquid-droplet jetting apparatus of the present invention will be described below with referring to FIG. 1 and FIG. 2. In the following description, a side toward which the ink is jetted is a lower surface and a direction of discharge is a downward direction, and a side opposite to the ink discharge is an upper surface and a direction is an upward direction. Moreover, in FIG. 1, a left-end side in the diagram is a left direction, a right-end side is a right direction, a lower side in the diagram is a frontward direction, and an upper side in the diagram is a rearward direction.

Figure 1:
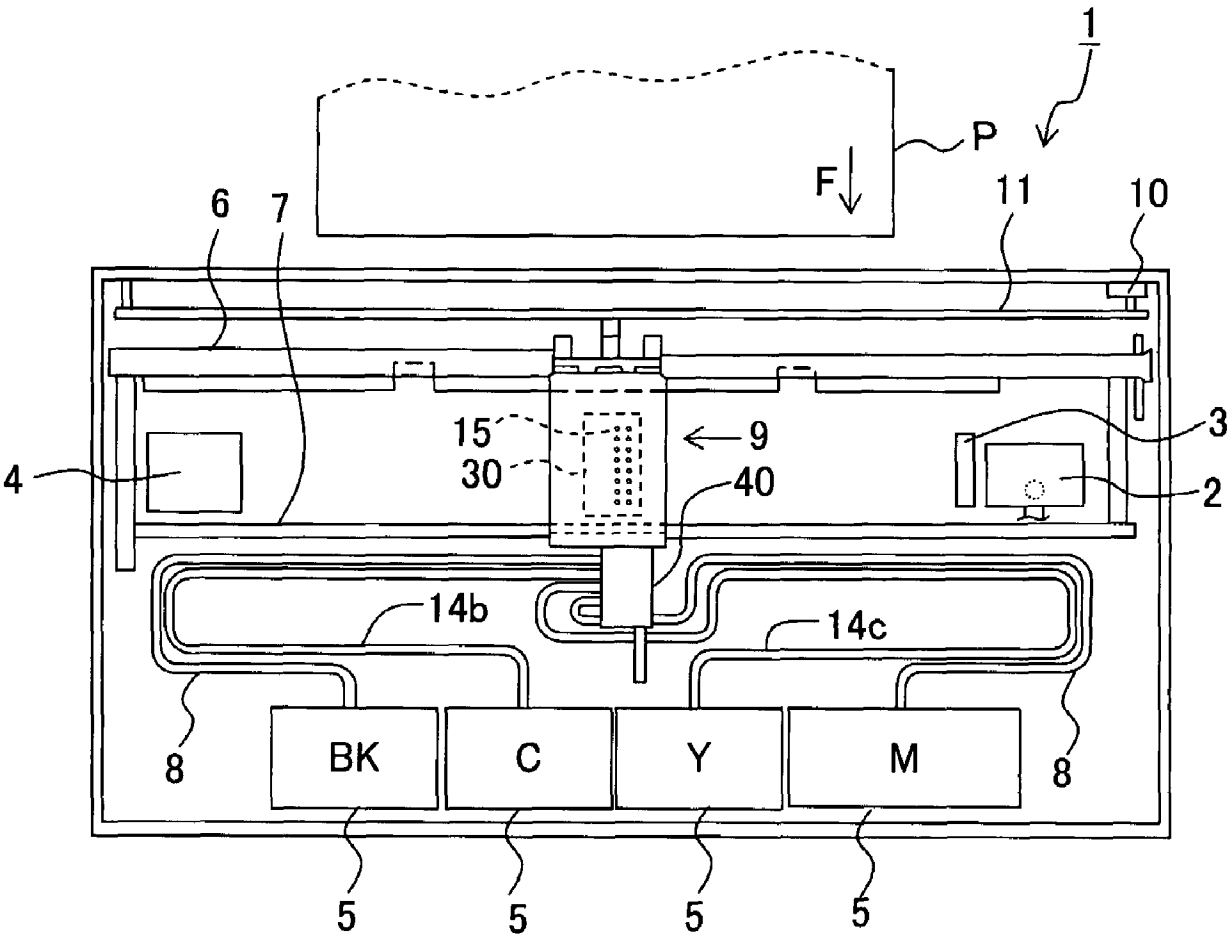
FIG. 1 is a diagram of an ink-jet printer 1.

As shown in FIG. 1, the ink-jet printer 1 is provided with two guide shafts 6 and 7 inside the ink-jet printer 1. A head holder which serves as a carriage 9 is installed on the guide shafts 6 and 7. A recording head 30 which performs recording by discharging the ink from nozzles 15 on to a recording paper P which is a recording medium, and an ink tank 40 which stores inks of various colors are mounted on the carriage 9. The carriage 9 is installed on an endless belt 11 which is rotated by a motor 10. The carriage 9 is driven by the motor 10 along the guide shafts 6 and 7 to perform a reciprocal moving in a direction of width of the recording paper P. The ink is jetted from the nozzles 15 when a drive pulse which jets the ink is applied to an actuator 31 (FIG. 2) of the recording head 30. When the ink is jetted, the recording paper P is sent in a direction of arrow F by a transporting unit not shown in the diagram, which is provided inside the ink-jet printer 1. The carriage 9 performs printing while performing the reciprocal moving in the direction of width (left and right direction) of the recording paper P.

Moreover, the ink-jet printer 1 includes a plurality of ink cartridges 5 in which inks of plurality of colors such as four colors namely black BK, cyan C, yellow Y, and magenta M are accommodated. Each ink cartridge 5 is connected to the ink tank 40 mounted on the carriage 9 by a flexible ink supply tube 8. The ink is stored in the ink tank 40 according to each color, and an ink of a predetermined color is supplied to each of the nozzles 15.

Furthermore, a flushed-ink receiving member (flushing receiving member) 4 is provided in a non-printing area at a left side of the ink-jet printer 1. Before starting the printing or during the printing, a flushing operation in which the ink is jetted from the nozzles 15 of the recording head 30 is performed periodically or forcibly, and a defective ink jetting is prevented. The flushed-ink receiving member 4 is formed of a porous material, and receives the wasted ink jetted from the recording head 30. Moreover, in a non-printing area at a right side of the ink-jet printer 1, similarly, a suction cap 2 which performs a suction purge process of sucking the ink inside the nozzles 15 is performed for preventing the malfunctioning of the ink jetting. The suction cap 2 is detachably provided to be in a close contact with a nozzle surface of the recording head 30, and when the suction cap is in a close contact with the nozzle surface, the suction operation is performed by a known motor. Moreover, in the non-printing area at a right side of the ink-jet printer 1, a wiper 3 is provided for wiping the ink adhered strongly to the nozzle surface, after the suction jetting.

Figure 2:
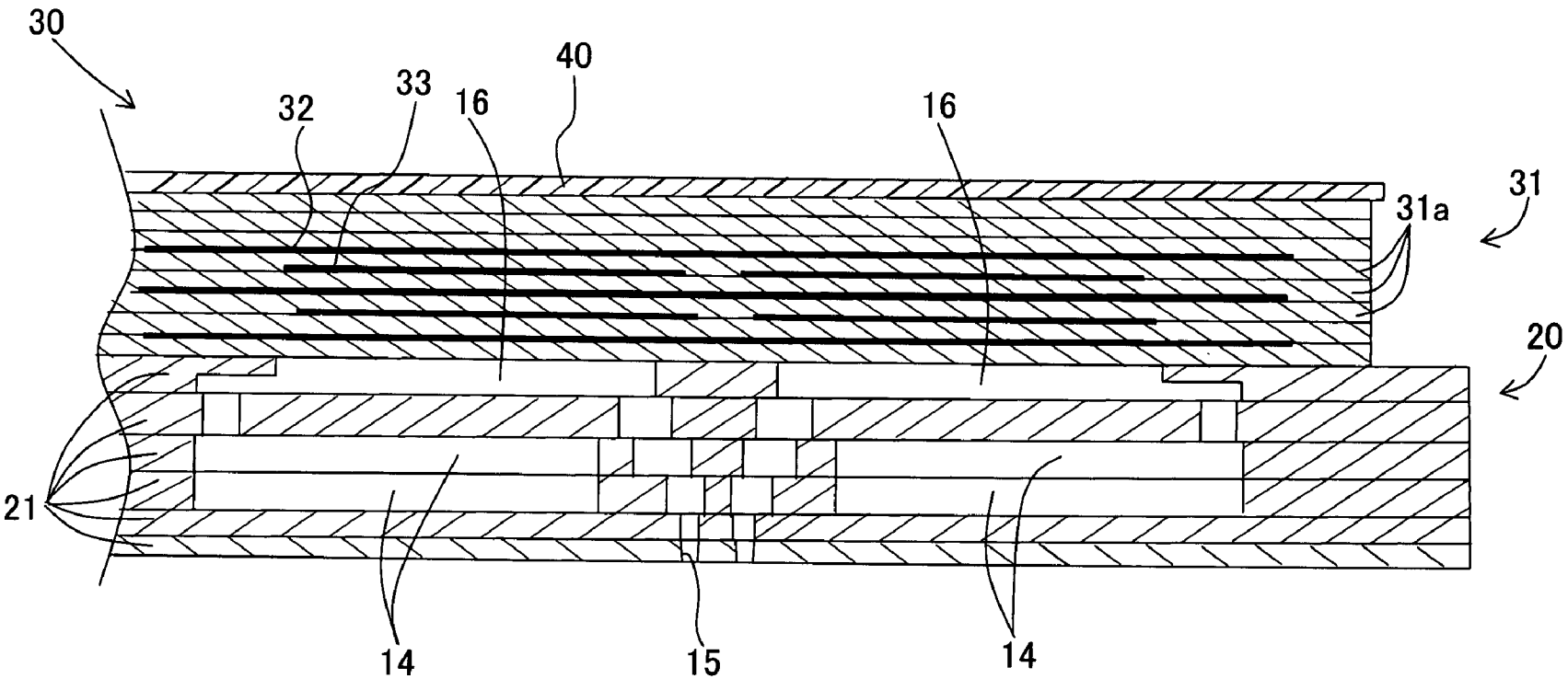
FIG. 2 is a side cross-sectional view of a recording head 30.

As shown in FIG. 2, the recording head 30, similarly as a hitherto known recording head described in U.S. Pat. No. 6,955,418 (corresponding to Japanese Patent Application Laid-open No. 2004-25636), the actuator 31 in the form of a plate is joined to a cavity unit 20, and on an upper surface of the actuator 31, a flexible wiring member 40 is electrically connected. The cavity unit 20 includes a plurality of stacked plates 21, and in a nozzle surface of the lowermost plate 21, the nozzles 15 are formed in the cavity plate 20, arranged in a row along a longitudinal direction of the plate 21. A plurality of pressure chambers 16 having a long and slender shape in a plan view, communicating with the nozzles 15 respectively are formed in the cavity plate 20, arranged in a row along the longitudinal direction of the uppermost plate 21. One end of the longitudinal direction of the pressure chambers 16 communicates with the nozzles 15 respectively, and the other end communicates with a manifold channel 14. The ink is supplied to the manifold channel 14 from the ink tank 40, which is then distributed from the manifold channel 14 to the pressure chambers 16, and further supplied to the nozzles 15.

A plurality of piezoelectric ceramics layers 31*a* of a material such as PZT (lead zirconate titanate) is formed in the actuator 31, and a thickness of each of the piezoelectric ceramics layers is about 30 μm. Individual electrodes 33 and common electrodes 32 sandwiching mutually are arranged alternately at positions corresponding to the pressure chambers 16 respectively. Each of the common electrodes is arranged commonly with respect to the plurality of pressure chambers. A driver IC chip which has a built-in driving circuit 49 is mounted on the flexible wiring member 40, and is connected to the electrodes 32 and 33 of the actuator 31. The driving circuit 49 generates a drive pulse which applies a voltage between the individual electrode 33 and the common electrode 32. By applying the voltage between the individual electrode 33 and the common electrode 32, it is possible to displace an active portion of the ceramics layer 31*a* sandwiched between these electrodes. Accordingly, a volume of the pressure chamber 16 is changed, and the ink is jetted from the nozzles 15.

Figure 3:
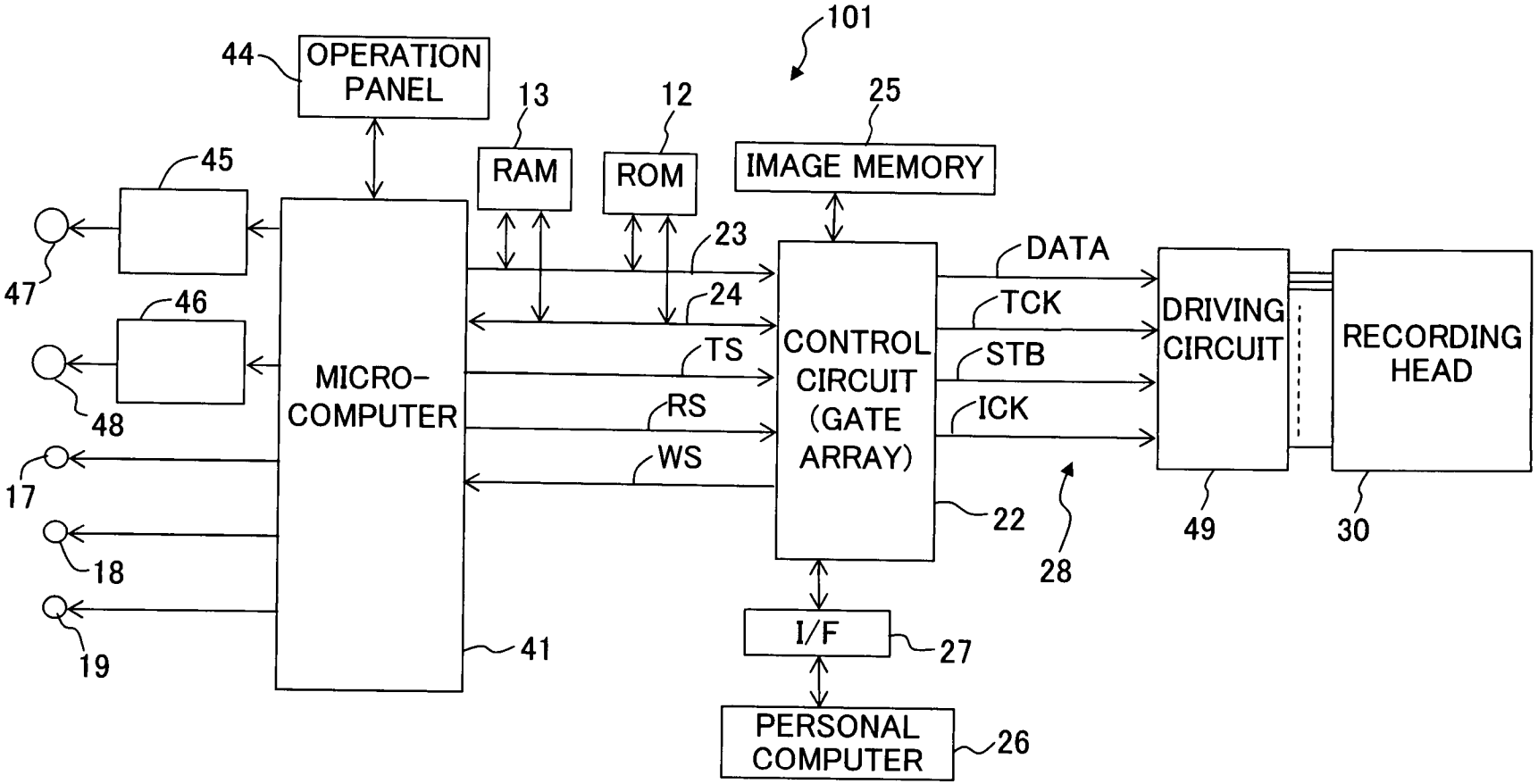
FIG. 3 is a block diagram showing an electric control of the ink-jet printer 1.

Next, an electrical structure of the ink-jet printer 1 of this embodiment will be described with referring to FIG. 3 and FIG. 4. FIG. 3 is a block diagram showing the electrical structure of the ink-jet printer 1. A control unit of the ink-jet printer 1 includes a one-chip microcomputer (CPU) 41 which controls each component of the entire ink-jet printer 1, a control circuit 22 which is a gate circuit LSI (large scale integrated gate circuit), a read only memory (ROM) 12 in which a control program, and driving wavelength data which causes an ink of each type (color) to be jetted are stored, and a random access memory (RAM) 13 which stores data temporarily. The CPU 41 is connected to an operation panel 44 which is for inputting various commands, a motor driver 45 for a carriage motor 47 which performs the reciprocal moving of the carriage 9, a motor driver 46 for a transporting motor 48 which drives the transporting unit, a paper sensor 17 which detects an availability of a printing paper, an origin sensor 18 which detects that the recording head 3 is at an origin, and an ink cartridge sensor 19 which detects that the ink cartridge 5 is in a normal mounted condition.

The CPU 41, the ROM 12, the RAM 13, and the control circuit 22 are connected via an address bus 23 and a data bus 24. Moreover, the CPU 41, in accordance with a computer program stored in advance, generates a printing timing signal TS and a control signal RS, and transfers the signals TS and RS to the control circuit 22. Moreover, the control circuit 22 stores in an image memory 25, printing data which is transferred from an external equipment such as a personal computer 26, via an interface 27. The control circuit 22 generates a reception interrupt signal WS from the data which is transferred from the personal computer 26 etc. via the interface 27, and transfers the reception interrupt signal WS to the CPU 41. The control circuit 22, in accordance with the printing timing signal TS and the control signal RS, based on the printing data stored in the image memory 25, generates a printing data signal DATA for forming an image corresponding to the printing data on a recording medium, a transfer clock TCK which is synchronized with the printing data signal DATA, a strobe signal STB, and a printing waveform signal ICK, and transfers these signals DATA, TCK, STB, and ICK to the driving circuit 49.

Figure 4:
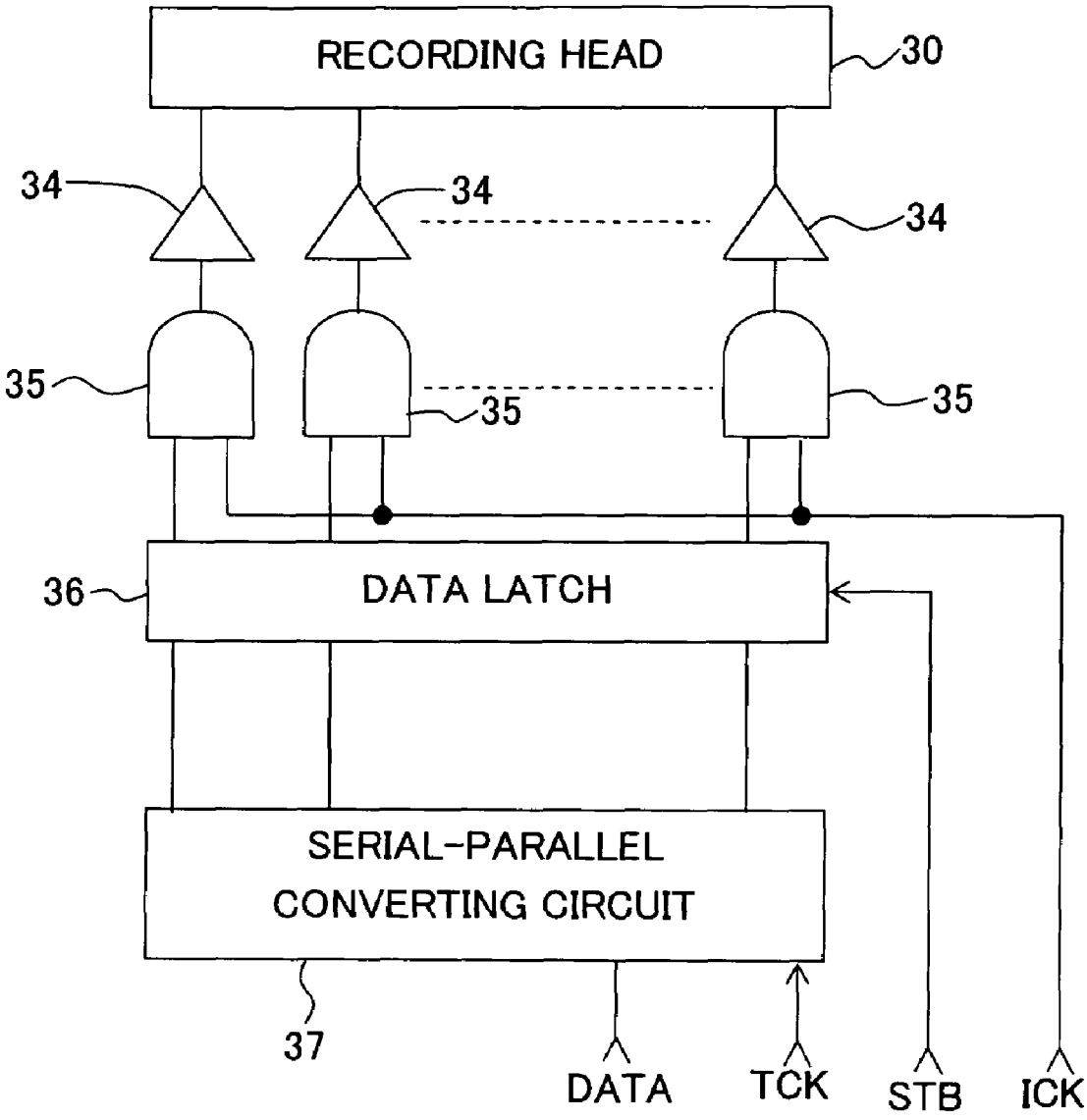
FIG. 4 is a diagram showing an internal structure of a driving circuit 49.

FIG. 4 shows an internal structure of the driving circuit 49. The driving circuit 49 includes a serial-parallel converting section 37 which converts the printing data signal DATA which is serial-transferred upon being synchronized with the transfer clock signal TCK from the data transfer section (not shown in the diagram) in the control circuit 22, to parallel data, a data latch 36 which latches the converted parallel data, based on the strobe signal STB, an AND gate 35 which selectively outputs the printing waveform data ICK based on the parallel data, and a driver 34 which outputs the printing waveform signal which is output, as a drive pulse converted to a voltage appropriate for the actuator 31. The drive pulse which is output from the driver 34 is applied to the individual electrode 32 of the recording head 30, and displaces the actuator 31. The number of serial-parallel converting sections 37, the data latches 36, the AND gates 35, and the drivers 34 is same as the number of nozzles 15 of the recording head 30. The driving waveform signal ICK includes a driving waveform signal for discharging the ink and a no-jetting driving waveform signal which vibrates the meniscus of the ink in the nozzles such that the ink is not jetted, which will be described later, and data of these signals is stored in the ROM 12 and read selectively based on the program control.

Figure 5A:
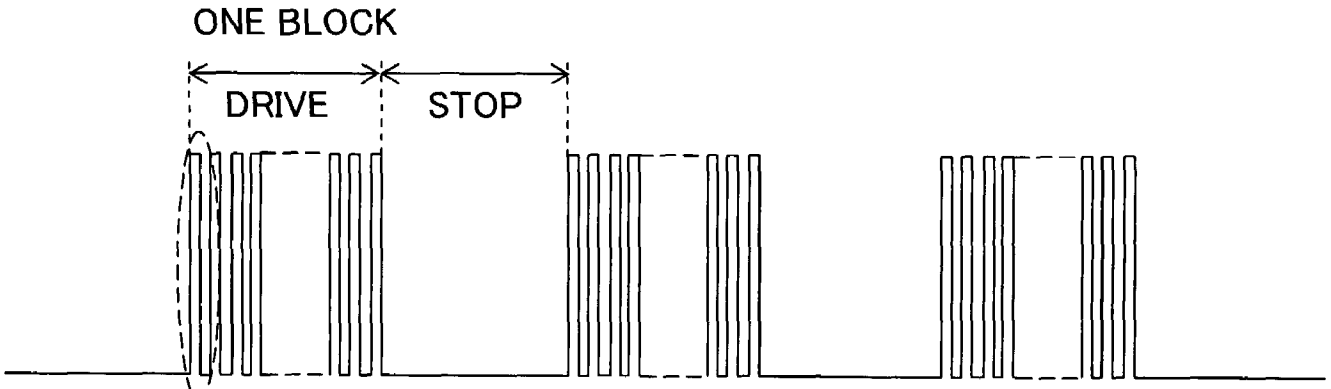
FIG. 5A is a diagram describing a no-jetting driving waveform which is used in this embodiment and FIG. 5B is a partial enlarged view of FIG. 5A.
Figure 5B:
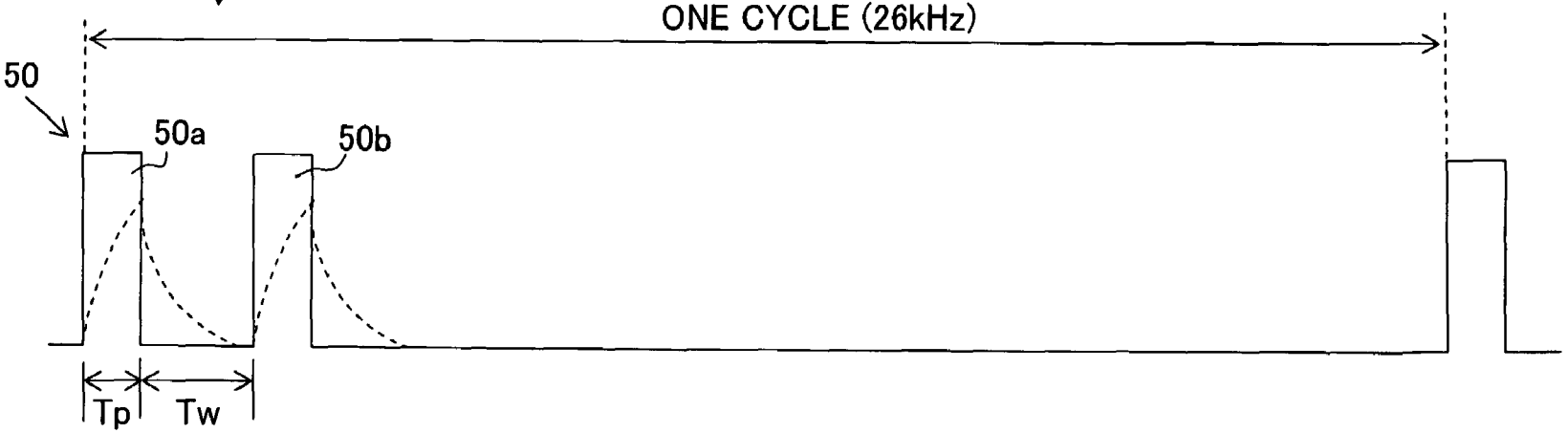

Next, the no-jetting drive pulse will be described below. FIG. 5A and FIG. 5B are waveforms of a signal which is output at the time of no-jetting drive. As shown in FIG. 5B, for one printing cycle (printing is not performed), there are two no-jetting drive pulses namely a first no-jetting drive pulse 50*a* and a second no-jetting drive pulse 50*b*. A drive frequency is 26 kHz, and a voltage is 22 V. A half of a cycle in which the pressure wave generated in the ink in the pressure chamber by displacement of the actuator 31 due to the applied drive pulse is AL, or in other words, a time for the pressure wave in a liquid channel of the jetting head including the pressure chamber to be propagated in one way is AL, a pulse width of one no-jetting drive pulse is Tp, and an interval between two pulses is Tw. Then, as it will be described later, Tp is set in a range of 0.1 AL to 0.35 Al, and Tw is set in a range of 0.1 AL to 4.5 AL. AL is affected not only by the natural frequency of the ink and a length of the ink channel in the cavity plate 20, but also by a channel resistance and a stiffness of each plate forming the channel. In this embodiment, AL is 4.5 μs.

The actuator 31 is equivalent to a condenser sandwiching the piezoelectric ceramics layer 31*a* between the electrodes. As in Tp mentioned above, when the time for which the voltage is applied is short, as it is shown by dashed lines in FIG. 5B, a point at which the voltage applied to the actuator 31 doesn't rise up to a maximum voltage of the drive pulse, the drive pulse falls. Consequently, the pressure which is capable of discharging the ink from the nozzle does not act on the ink in the pressure chamber 16, and it is possible to impart only the vibrations to the meniscus of the ink in the nozzle.

In the embodiment described above, the voltage is applied to the actuator only for the time corresponding to the width Tp of the drive pulse. However, it is also possible to reduce the volume of the pressure chamber 16 by applying the voltage to the actuator 31 in the normal state. In other words, it is also possible to repeat an operation of returning the volume of the pressure chamber 16 to the original volume by stopping applying the pressure to the actuator during the width Tp of the drive pulse, and an operation of reducing the volume of the pressure chamber 16 once again during the pulse interval Tw.

Regarding the pulse width and the pulse interval to be applied to the actuator 31, an optimization of a timing of the pulse width Tp and the pulse interval Tw of the no-jetting drive pulse so as to impart the vibrations to the meniscus of the ink in the nozzle without discharging the ink from the nozzle was studied. The result is shown in FIG. 6. As shown in FIG. 6, the pulse is applied upon combining a plurality of pulse widths Tp and a plurality of pulse intervals Tw. Here, since an environmental temperature in which the ink-jet head is used has an effect on a drying speed of ink, an environmental temperature was set to be 14° C., 24° C., and 34° C., and whether or not the ink is jetted at these environmental temperatures was observed. Specifically, in each of the environmental temperatures, the humidity was kept at about 20%. In such situations, voltage pulses which is 2 volts higher than a predetermined voltage were applied to the actuator in 100%, 50% and 30% of duty cycles, and whether or not the ink is jetted was observed. In an evaluation result, a case in which the ink was not jetted at any of the three temperatures was let to be A (or AA), a case in which the ink was jetted at the environmental temperature of 34° C. or more was let to be B, a case in which the ink was jetted at the environmental temperature of 24° C. or more was let to be C, and a case in which the ink was jetted at each of the three temperatures was let to be D. In FIG. 6, although there is some error for each value used in the experiment, inventors of the present invention found that the result was almost the same. For example, Tp=0.13 AL is equivalent in a range of about 0.1 AL≦Tp≦0.15 AL.

According to FIG. 6, the values of Tp and Tw were combined in a range of 0.1 AL≦Tp≦0.35 AL, and in a range of 0.1 AL≦Tw≦4.5 AL, and the voltage was applied. Accordingly, in ranges $$0.2AL \leqq Tp \leqq 0.35AL,\ 0.1AL \leqq Tw \leqq 0.2AL \quad (1)$$

$$0.25AL \leqq Tp \leqq 0.35AL,\ 0.2AL \leqq Tw \leqq 0.4AL, \quad (2)$$

a result (D) that ink is jetted in any of the environmental temperatures was obtained.

Moreover, in ranges $$0.1AL \leqq Tp \leqq 0.2AL,\ 0.2AL \leqq Tw \leqq 4.5AL \quad (3)$$

$$0.1AL \leqq Tp \leqq 0.15AL,\ 0.1AL \leqq Tw \leqq 4.5AL \quad (4)$$

$$0.1AL \leqq Tp \leqq 0.35AL,\ 0.4AL \leqq Tw \leqq 1.0AL \quad (5)$$

$$0.1AL \leqq Tp \leqq 0.3AL,\ 0.4AL \leqq Tw \leqq 1.5AL \quad (6)$$

$$0.1AL \leqq Tp \leqq 0.3AL,\ 2.5AL \leqq Tw \leqq 3.5AL \quad (7)$$

$$0.1AL \leqq Tp \leqq 0.25AL,\ 2.5AL \leqq Tw \leqq 4.5AL \quad (8)$$

$$0.1AL \leqq Tp \leqq 0.3AL,\ 4.2AL \leqq Tw \leqq 4.5AL \quad (9)$$

the ink is not jetted at any of the environmental temperatures (A or AA).

Thus, within the range of the result mentioned above, the ink is not jetted at any of the environmental temperatures. Following measurement have been made in order to obtain an optimum no-jetting drive pulse. At first a flushing operation has been performed. After stopping for 0.5 second, a line in one dot width (or a rectangular block shape in one dot width) is printed on a recording medium. Whether a defect of a dot in the printed line is present or not has been examined to find out a clogging in the nozzles. The mark "AA" indicates that there is no clogging in the nozzles. In this case, the clogging of the nozzles due to an increase of the viscosity of the ink is considered to be prevented because a sufficient vibration is imparted to the meniscus of the ink and a thickened liquid and a new liquid are stirred sufficiently in the nozzles. According to this no-jetting drive pulse, it is desirable to used a no-jetting drive pulse in ranges $$0.15AL \leqq Tp \leqq 0.2AL,\ 2.0AL \leqq Tw \leqq 3.5AL \quad (10)$$

$$0.15AL \leqq Tp \leqq 0.25AL,\ 2.5AL \leqq Tw \leqq 3.0AL. \quad (11)$$

Moreover, it is preferable that AL is approximately 4.5 μs, Tp is in a range of 0.7 μsec to 1.1 μsec, and Tw is approximately 12 μs.

In the no-jetting drive mentioned above, a series of operations in which the drive pulse formed of two pulses as in FIG. 5B is output continuously for a predetermined number of times at a frequency of 26 kHz, and then stopped for a predetermined portion of a cycle, and output once again continuously, is repeated. For example, the no-jetting drive is performed with an operation of outputting repeatedly the no-jetting drive pulse including the two pulses for 100 cycles to 150 cycles, as one block, and then with a stopping interval of one cycle, the operation of no-jetting drive of one block is performed again repeatedly. It is preferable that the no-jetting drive of one block is performed as shown in FIG. 5A, then, with a stopping interval of 100 cycles to 150 cycles, the no-jetting operation of one block is repeated once again. Moreover, an arrangement may be made such that the no-jetting drive of one cycle is performed, and then, with a stopping interval of one cycle, once again the no-jetting drive operation is performed.

Thus, the pulse width of the no-jetting drive pulse is shorter than the pulse width of a drive pulse for ink jetting, and the voltage of the no-jetting drive pulse is lower than the voltage of the drive pulse. By applying a no-jetting drive pulse having a no-jetting driving waveform satisfying the conditions mentioned above, from the driving circuit 49 to the actuator 31, it is possible to prevent the ink in the nozzle opening from drying by imparting the vibration to the meniscus of the ink at the nozzle opening, to an extent such that the ink is not jetted, and by stirring the ink near the meniscus. Moreover, by repeating alternately this operation for predetermined cycles and stopping, the stirring of ink is not repeated monotonously, but with variation. Therefore, it is possible to stir effectively the ink thickened due to drying. Moreover, since it is possible to suppress during the stopping time, the reverberation due to the vibration, an adverse effect on the printing performance is suppressed.

Next, a printing operation of this embodiment including the no-jetting drive will be described below with referring to FIG. 7, FIG. 8, and FIG. 9. A computer program for a printing control operation of the ink-jet printer 1 in FIG. 8 is stored in the ROM 12 shown in FIG. 3, and is executed by the CPU 41. Practically, after the printing operation of the ink-jet printer 1 is started, for preventing misfiring of ink by the recording head 30, a process in which a judgment of whether or not an auxiliary jetting such as a flushing operation is to be performed is made, and the auxiliary jetting is carried out according to the requirement, is available. However, this process is omitted in FIG. 8 and FIG. 9.

When a print command (instruction) is input (S1), an operation of printing image data of one line which is stored in the image memory 25 is started. Due to a drive by the carriage motor 47, the carriage 9 moves along a direction of a width (direction G in FIG. 7) of the recording paper P. Moreover, the printing data signal DATA corresponding to the image data stored in the image memory 25 is read in an order by the control circuit 22, in accordance with the drive of the carriage 9. The drive voltage is selectively applied to the individual electrodes 33 of the actuator 31 via the driving circuit 49, and one-movement printing operation(one-scan printing operation) is executed (S2).

Figure 7:
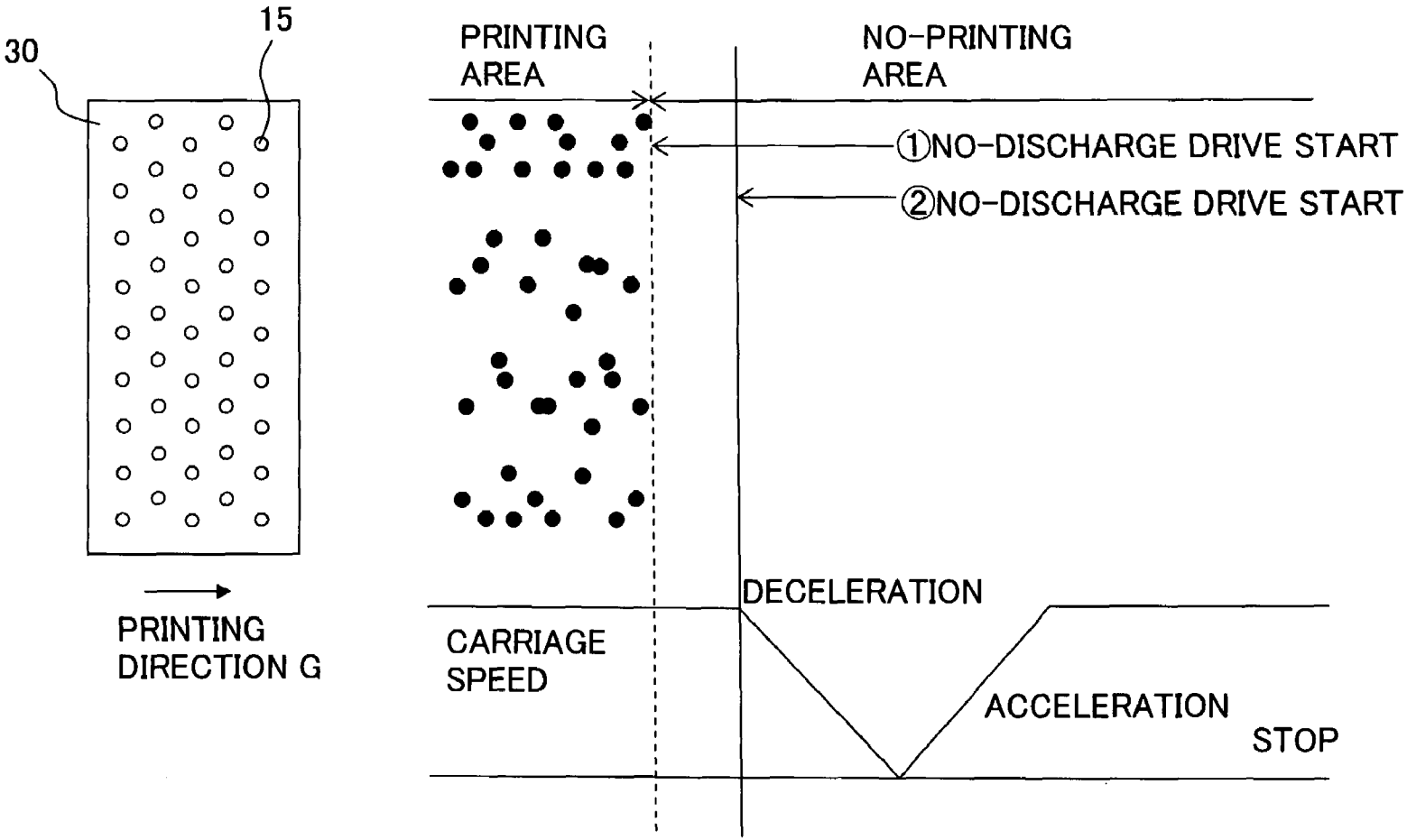
FIG. 7 is a diagram describing a carriage operation.
Figure 8:
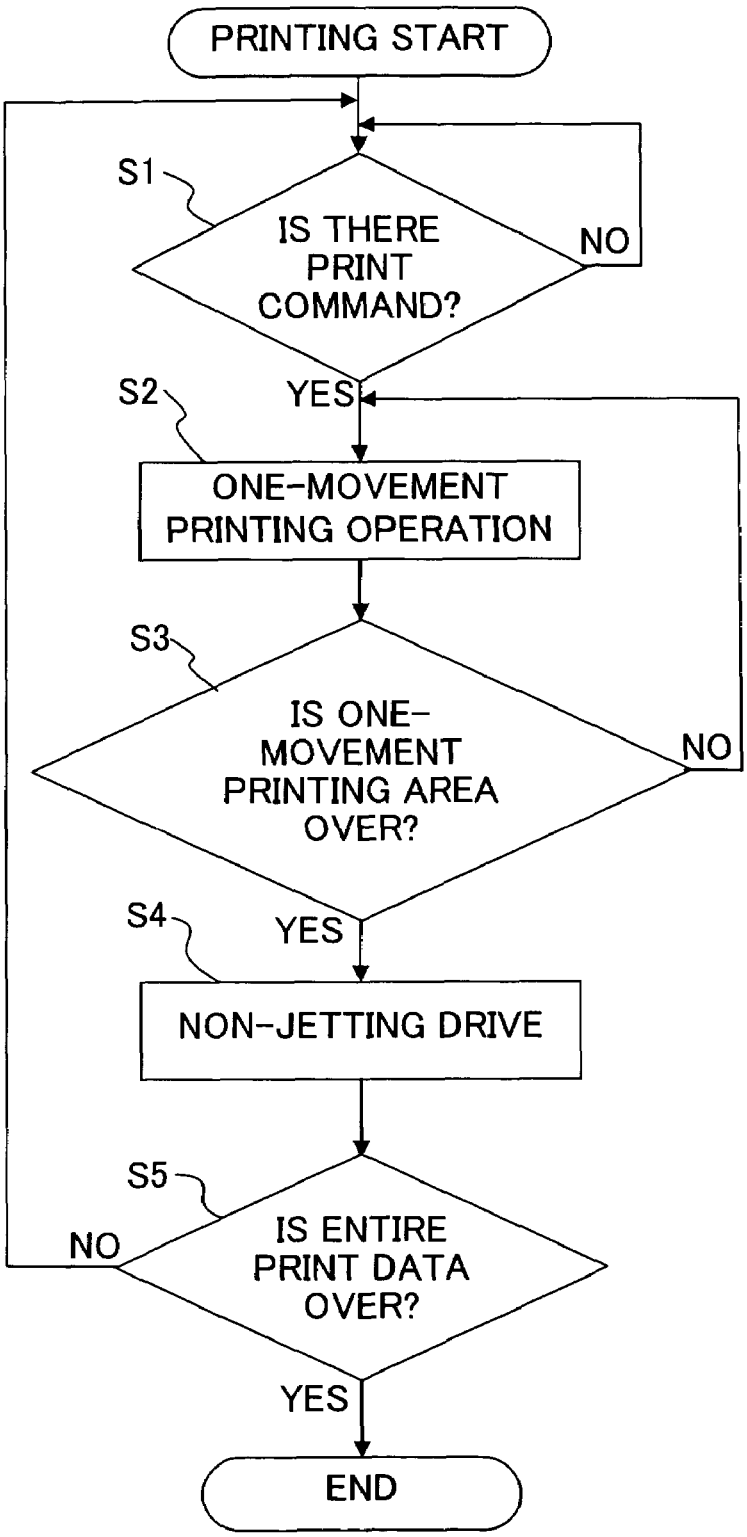
FIG. 8 is a flowchart describing a printing operation.

The one-movement printing operation mentioned above is repeated during the time when the one-movement is performed along a moving direction of the carriage 9, in other words, when the carriage 9 is in the printing area, and as the carriage 9 is out of the printing area (as the printing area is over (S3)), the vibrations are imparted to the ink at the nozzle opening without discharging the ink (S4) (no-jetting drive starts from (1) in FIG. 7).

In the no-jetting drive (S4), in accordance with the computer program stored in the ROM 12, a drive data signal equivalent to the printing data signal DATA for all nozzles 15 is loaded from the ROM 12, and the driving waveform of the no-jetting drive in FIG. 5B stored in ROM 12 is loaded. Accordingly, the drive data signal having the driving waveform of the no-jetting drive is output to the driving circuit 49, and the actuator 31 is driven. The no-jetting drive for three blocks is performed, and as it has been mentioned above, a stopping time of 100 cycles to 150 cycles is included in each block. After this, a judgment of whether or not the printing of all the printing data is over is made (S5), and when the printing data is still left, the carriage 9 is decelerated, then turned about and accelerated, and is returned once again to a recording-start position, and a series of printing operations is executed once again. Further, when the entire printing data is processed, the printing operation is terminated.

Thus, in the printing operation of this embodiment, immediately after the carriage 9 has gone out of the printing area in which the dot is formed, the vibrations are imparted to the ink meniscus near the nozzle opening.

Figure 9:
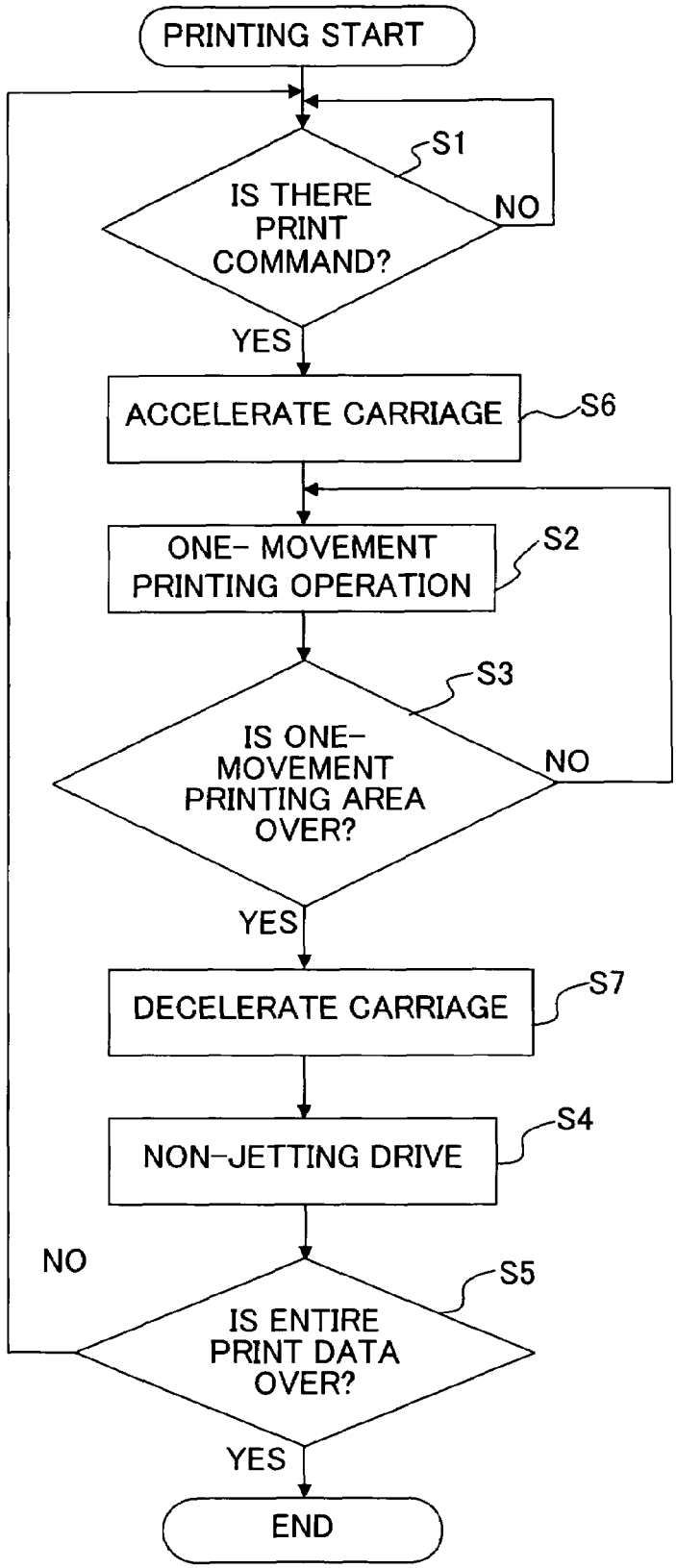
FIG. 9 is a flowchart describing a printing operation in another embodiment.

FIG. 9 shows another embodiment. In FIG. 9, after the print command is input (S1), the carriage 9 is accelerated (S6). S6 may be executed similarly in an embodiment in FIG. 8 also. Next to S6, the printing operation of one-movement similarly as in the embodiment in FIG. 8 is performed (S2 and S3), and the carriage 9 is decelerated (S7). Simultaneously with the deceleration of the carriage 9, the no-jetting drive is performed similarly as in the embodiment in FIG. 8 (S4) (no-jetting drive starts from (S2) in FIG. 7), the meniscus of the ink in the nozzle vibrates. Further, the operation mentioned above is repeated till the entire printing data is over (S5). In other words, during the printing operation, the carriage 9 jets ink while moving the printing area of the recording paper P, and in the no-printing area on both sides of the printing area of the recording paper P, the vibrations are imparted to the ink meniscus near the nozzle opening while the carriage 9 is decelerated.

By performing such printing operation, it is possible to stir the ink while making vibrate the meniscus of the ink near the nozzle opening, and to suppress the drying of the ink. Particularly, since it is possible to impart the vibrations to the meniscus of the ink even for the nozzle 15 with a low frequency of jetting among the nozzles 15 of the recording head 30, it is possible to prevent an unstable jetting of ink due to the thickening of the ink for all nozzles 15.

In each of the embodiments described above, in the no-jetting drive (S4), the driving waveform of no-jetting is output only for fixed time (for example, three blocks in FIG. 5) from the start thereof. However, when the printing data is still remained, the vibrations may be imparted to the meniscus till just before the printing operation in the printing area of the subsequent movement. Moreover, an arrangement may be made such that the no-jetting drive (S4) operation is performed once for a plurality of movements instead of for each movement of the carriage 9.

Thus, even without performing the flushing operation frequently during the printing operation, it is possible to impart sufficiently the vibrations to the meniscus near the nozzle by using the time for one movement (one scan) by the carriage 9 according to the no-jetting drive described above. Therefore, it is possible to prevent routinely the thickening of ink due to drying of ink, and to prevent a decline in the printing quality. Moreover, even for a paper having a narrow width such as a postcard, it is less necessary for the carriage 9 to move through excessive distance for the flushing operation. Therefore, a decrease in the printing speed and a wasteful consumption of the ink are suppressed. Moreover, from among the nozzles 15 of the recording head 30, the no-jetting drive is performed also for the nozzle 15 with less number of printings. Therefore, it is particularly effective in stirring the ink which is thickened.

The printing operation including the no-jetting operation described above is effective when the flushing operation and the no-jetting drive operation are combined selectively. Moreover, when printing performance of high resolution as in photographic image etc. is required, an arrangement may be made such that the number of no-jetting drive pulses in one cycle are increased to be more than the number of pulses in a normal low resolution printing mode, and the no-jetting drive pulse is supplied without fail after each movement. An operation of increasing or decreasing the no-jetting drive pulse may be performed from the operation panel by a user, upon making a judgment from the printing result.

Furthermore, in an ink-jet printer of printing type in which the number of nozzles 15 of the recording head 30 which jet the ink differ according to the printing mode, an arrangement may be made such that only the nozzles 15 used according to the printing mode performs the flushing operation and the no-jetting drive.

Moreover, it is also possible to increase or decrease the number of no-jetting drive pulses according to the printing pattern (dot density), by detecting the printing pattern of the printing area which is loaded from the image memory 25. For example, in the printing pattern of the printing data signal DATA of the printing area in which the printing is to be performed from now onward, when the dot density is lower than a predetermined value, the number of no-jetting drive pulses before entering into the printing operation of that printing area is decreased, and when the dot density is higher, more (number of) no-jetting drive pulses are generated. Moreover, as another example, in a nozzle which jets a large number of big dots, the number of no-jetting drive pulses may be increased or decreased for each nozzle according to the printing pattern such that the number of no-jetting drive pulses is decreased since it is hardly affected by the drying of ink, and the number of no-jetting drive pulses is increased for the nozzles which do not jet frequently. Such an arrangement is effective in suppressing a generation of heat in the jetting head and the driving circuit. Moreover, the similar effect is achieved by making an arrangement such that a waveform of the no-jetting drive pulse is changed instead of increasing or decreasing the number of no-jetting drive pulses for each nozzle.

Furthermore, according to a width of the printing area, it is possible to combine the flushing operation and the no-jetting drive. When the printing is over during one movement of the printing operation of the carriage 9, in a case in which a carriage position is near the flushed-ink receiving member 4 which is arranged at the no-printing area of the ink-jet printer 1, the carriage 9 moves up to the no-printing area, and the flushing operation is performed. When the carriage position is far away from the flushed-ink receiving member 4, the no-jetting drive is performed at a carriage position where the printing is over, and without performing the flushing operation, the carriage 9 is moved to a printing start position of the subsequent printing area. When such an arrangement is made, it is not necessary to perform the flushing operation frequently, and it is possible to reduce the wasteful consumption of ink. Moreover, since the time for moving up to the flushing position is cut short, it is possible to reduce an overall printing time.

As shown in FIG. 5, in this embodiment, a printing cycle of one dot (one cycle) of the no-jetting driving waveform, includes two no-jetting drive pulses 50*a* and 50*b*. The drive frequency (reciprocal of printing cycle) at this time is 26 kHz. An arrangement may be made such that the generation of heat in the jetting head and the driving circuit is suppressed by reducing a duty of the pulse waveform by setting this no-jetting driving waveform ranging over the two printing cycles, or by decreasing the number of pulses in one cycle, or by lowering the drive frequency.

Thus, (in) the no-jetting drive, not only a jetting defect due to the drying of ink is prevented but also an effect such as the reduction in the wasteful consumption of ink, and the cutting short of the printing time are achieved by combining the flushing operation, by increasing or decreasing the number of no-jetting drive pulses, or by deforming the waveform according to the object of printing and the printing performance which is required.

Moreover, an overall effect is improved by performing the no-jetting drive in combination with other functions and control of the ink-jet printer 1. An example of the improved overall effect will be described below.

When there is an excessive generation of heat in the recording head 30 and the driving circuit 49, the ink-jet printer 1 starts malfunctioning due to the (excessive) heat, and the jetting of ink becomes unstable. Therefore, a temperature detecting mechanism such as a thermistor which controls the temperature of the recording head 30 and the driving circuit 49 is installed on the head holder. When the flushing operation and the no-jetting drive during the printing operation are compared, since more (a large) number of pulses is generated in the no-jetting drive, it is assumed (anticipated) that a large amount of heat is generated during the no-jetting drive. Therefore, when the amount of heat generated is large (more) based on the temperature detected during the printing operation, by switching to the flushing operation from the no-jetting drive, it is possible to suppress an effect of heat generation on the recording head 30 and the driving circuit 49.

As it has been mentioned earlier, the thickening (of the ink) due to the drying of the ink at the meniscus near the nozzle opening of the recording head 30 leads to a jetting defect. However, sometimes the ink in the recording head 30 is thickened entirely. For example, when the ink in each ink cartridge 5 which supplies the ink to the recording head 30 or in each ink supply tube 8 becomes old, and the ink is thickened due to the drying of ink, the suction purge is not performed routinely for the nozzles 15 of the recording head 30, sometimes the ink in the recording head 30 remains thickened as it has been, without being sucked. In such case, since the ink which is already thickened is further thickened near the nozzle opening, a possibility of leading to the jetting defect becomes high. Therefore, in the printing operation which includes the no-jetting drive, the number of no-jetting drive pulses may be increased according to a state of the ink which is supplied to the recording head 30. For example, in the printing operation which includes the no-jetting drive, a computer program which has a function of a counter (timer) which counts a time elapsed since the ink cartridge 5 is replaced or mounted is provided to a control program which is stored in the ROM 12, and a judgment of whether or not the elapsed time is more than a predetermined stipulated value (for example five days) is made. At this time, in a case in which, the elapsed time is more than the stipulated value, by performing a control of increasing the number of no-jetting drive pulses, it is possible to stir sufficiently the old thickened ink, and an effect of suppressing the printing defect is achieved. Moreover, as another example, in the printing operation which includes the no-jetting drive, a computer program which has a function of a counter (timer) which counts time till the printing operation command is input after the suction purge of the nozzle 15 of the recording head 30 is performed finally is provided to the control program which is stored in the ROM 12, and a judgment of whether or not the elapsed time is more than the predetermined stipulated value is made. At this time, in a case in which, the elapsed time is more than the stipulated value, by performing the control of increasing the number of no-jetting drive pulses, it is possible to stir sufficiently even the ink which is thickened without being sucked, and the effect of suppressing the printing defect is achieved.

It has been known that when a plurality of pressure chambers 16 is provided in a row in the recording head 30 as in FIG. 2, by performing the jetting operation in one of the pressure chambers, a so-called cross-talk which is a phenomenon in which a pressure wave generated due to the jetting operation is propagated to the other pressure chambers 16, occurs. Due to such cross-talk, the ink is not jetted from the nozzle 15 corresponding to the pressure chamber 16 which is not driven, but the vibrations are imparted to the ink in the nozzle 15. Since the cross-talk, similar to the no-jetting drive, has a property of imparting the vibrations to the ink, it is possible to decrease the number of no-jetting drive pulses by using this property, and to suppress the generation of heat from the recording head 30 and the driving circuit 49. For example, the pressure chambers 16 are (may be) divided in two groups namely a group of odd numbered pressure chambers 16, and a group of even numbered chambers 16 in a direction of arrangement (of pressure chambers 16). Even in this case, when no-jetting pulses are applied to the pressure chambers in one group, the vibrations are imparted to the ink in the pressure chamber 16 in the other group. Therefore it is possible to prevent the thickening of ink. By performing this at an appropriate time interval for each group alternately, it is possible to reduce the frequency of imparting the no-jetting drive pulse.

As it has been mentioned above, by using the no-jetting drive pulse and the other function and control of the ink-jet printer, is not only possible to prevent effectively the jetting defect due to the thickening of ink, but also to achieve an effect on the entire ink-jet printer such as reducing the generation of heat by the recording head 30 and the driving circuit 49.

Thus, the embodiment in which the present invention is applied to the ink-jet printer has bee described. However, the present invention is also applicable to apparatuses such as an apparatus which applies a colored liquid as very small (fine) liquid droplets. For example, a liquid-droplet jetting apparatus of the present invention is not limited to the ink-jet head (or printer) which jets the ink, the liquid-droplet jetting apparatus may be an apparatus which jets a liquid other than ink such as a reagent, a biomedical solution, a wiring material solution, an electric material solution, a cooling medium (refrigerant), a liquid fuel, or the like.

What is claimed is:

1. A liquid-droplet jetting apparatus which jets a droplet of a liquid onto a medium, comprising:

a head which includes a pressure chamber in which the liquid is filled, a nozzle which communicates with the pressure chamber, a channel which is extended from the pressure chamber up to the nozzle, and an actuator which changes a volume of the pressure chamber; and a controller which controls the actuator to impart vibration to a meniscus of the liquid in vicinity of the nozzle by applying no-jetting drive pulses, which causes no jetting of the liquid onto the medium, to the actuator wherein:

when a period of time during which a pressure wave generated due to the vibration is propagated in one way through the channel is AL, a pulse width of the no-jetting drive pulses is Tp, and an interval between each of the no-jetting drive pulses is Tw, a waveform of the no-jetting drive pulses satisfies one of $$0.1AL \leqq Tp \leqq 0.2AL,\ 0.2AL \leqq Tw \leqq 4.5AL;$$

$0.1AL \leqq Tp \leqq 0.15AL$, $0.1AL \leqq Tw \leqq 4.5AL$;

$0.1AL \leqq Tp \leqq 0.35AL$, $0.4AL \leqq Tw \leqq 1.0AL$;

$0.1AL \leqq Tp \leqq 0.3AL$, $0.4AL \leqq Tw \leqq 1.5AL$;

$0.1AL \leqq Tp \leqq 0.3AL$, $2.5AL \leqq Tw \leqq 3.5AL$;

$0.1AL \leqq Tp \leqq 0.25AL$, $2.5AL \leqq Tw \leqq 4.5AL$; and $0.1AL \leqq Tp \leqq 0.3AL$, $4.2AL \leqq Tw \leqq 4.5AL$.

2. The liquid-droplet jetting apparatus according to claim 1, wherein the waveform of the no-jetting drive pulses satisfies $0.15AL \leqq Tp \leqq 0.2AL$, $2.0AL \leqq Tw \leqq 3.5AL$.

3. The liquid-droplet jetting apparatus according to claim 1, wherein the waveform of the no-jetting liquid drive pulses satisfies $0.15AL \leqq Tp \leqq 0.25AL$, $2.5AL \leqq Tw \leqq 3.0AL$.

4. The liquid-droplet jetting apparatus according to claim 1, wherein the no-jetting drive pulses are output repeatedly at a first cycle, and number of the no-jetting drive pulses output in the first cycle is in a range of one to three.

5. The liquid-droplet jetting apparatus according to claim 4, wherein after the no-jetting drive pulses are output repeatedly at the first cycle, the no-jetting drive pulses are stopped during a second cycle which has a length not less than the first cycle.

6. The liquid-droplet jetting apparatus according to claim 1, further comprising: a carriage on which the head is mounted, and which moves reciprocally in a direction of a width of the medium, wherein: the controller controls the carriage to move along the medium, and after an operation of jetting the droplet on to the medium is completed, the controller imparts the vibration to the meniscus of the liquid in the vicinity of the nozzle by supplying the no-jetting drive pulses to the actuator.

7. The liquid-droplet jetting apparatus according to claim 6, wherein the controller continues to impart the vibration to the meniscus of the liquid till just before the carriage arrives at a subsequent jetting area.

8. The liquid-droplet jetting apparatus according to claim 6, wherein the controller imparts the vibration to the meniscus of the liquid for a fixed period of time after starting a supply of the drive pulses to the actuator.

9. The liquid-droplet jetting apparatus according to claim 1, further comprising: a carriage on which the head is mounted, and which moves reciprocally in a direction of a width of the medium, wherein: the controller controls the carriage to move along the medium, and with a termination of an operation of jetting the droplet on to the medium, the controller decelerates the carriage, and at the same time, imparts the vibration to the meniscus of the liquid in the vicinity of the nozzle by supplying the no-jetting drive pulses to the actuator.

10. The liquid-droplet jetting apparatus according to claim 9, wherein the controller imparts the vibration to the meniscus of the liquid till just before the carriage arrives at a subsequent jetting area.

11. The liquid-droplet jetting apparatus according to claim 9, wherein the controller imparts the vibration to the meniscus of the liquid for a fixed period of time after starting a supply of the drive pulses to the actuator.

12. The liquid-droplet jetting apparatus according to claim 1, further comprising a flushing mechanism which performs flushing of the head.

13. The liquid-droplet jetting apparatus according to claim 12, wherein the controller includes a thermometer which measures a temperature of the liquid, and controls the flushing mechanism to perform the flushing of the head when the temperature of the liquid is higher than a predetermined temperature.

14. The liquid-droplet jetting apparatus according to claim 1, further comprising a cartridge which accommodates the liquid, and which is exchangeable, wherein the controller includes a timer which measures a time elapsed after the cartridge has been replaced, and the controller imparts the vibrations to the meniscus of the liquid when the elapsed time exceeds a predetermined time.

15. The liquid-droplet jetting apparatus according to claim 1, further comprising a purge mechanism which performs a purge of the head, wherein the controller includes a timer which measures a time elapsed after the purge of the head has been performed, and when the elapsed time exceeds a predetermined time, the controller imparts the vibration to the meniscus of the liquid by increasing a number of the no-jetting drive pulses.

* * * * *